US006557817B2

(12) United States Patent
Waldschmitt et al.

(10) Patent No.: US 6,557,817 B2
(45) Date of Patent: May 6, 2003

(54) WALL CLIMBING FORM HOIST

(75) Inventors: Thomas Joseph Waldschmitt, Des Moines, IA (US); Randy Pauley, Des Moines, IA (US)

(73) Assignee: Wilian Holding Company, Des Moines, IA (US)

( * ) Notice: Subject to any disclaimer, the term of this patent is extended or adjusted under 35 U.S.C. 154(b) by 0 days.

(21) Appl. No.: 09/484,635

(22) Filed: Jan. 18, 2000

(65) Prior Publication Data

US 2003/0052249 A1 Mar. 20, 2003

(51) Int. Cl.[7] ..... E04G 9/00; E04G 11/00

(52) U.S. Cl. ..... 249/20; 249/19; 249/26; 249/192; 182/36; 182/82; 425/65; 264/33

(58) Field of Search ..... 249/10, 19, 20, 249/22, 26, 188, 189, 192; 425/63, 65; 264/31, 33, 34; 182/36, 37, 82, 141

(56) References Cited

U.S. PATENT DOCUMENTS

| | | | | | |
|---|---|---|---|---|---|
| 2,516,318 | A | * | 7/1950 | Hawes | 425/63 |
| 3,472,477 | A | * | 10/1969 | Juhl | 249/20 X |
| 3,628,223 | A | * | 12/1971 | Babee | 425/65 |
| 3,779,678 | A | * | 12/1973 | Scheller | 425/65 |
| 3,973,885 | A | * | 8/1976 | Schmidt | 425/65 |
| 4,040,774 | A | * | 8/1977 | Scheller | 425/65 |
| 4,060,358 | A | * | 11/1977 | Fougea | 249/20 |
| 4,126,407 | A | * | 11/1978 | Ahlgren | 249/10 X |
| 4,147,483 | A | * | 4/1979 | Rovera et al. | 249/20 X |
| 4,290,576 | A | * | 9/1981 | Schworer | 249/20 |
| 4,374,634 | A | * | 2/1983 | Ahl | 249/20 X |
| 4,530,638 | A | | 7/1985 | Phillips | |
| 4,917,346 | A | * | 4/1990 | Mathis | 249/20 |
| 5,000,287 | A | * | 3/1991 | Schworer | 182/82 |

FOREIGN PATENT DOCUMENTS

GB 2021672 A * 12/1979

OTHER PUBLICATIONS

"HSCF Self–Climbing Formwork", Thyssen Hunnebeck GmbH, 2 pages, Worldwide sales–organization, P.O. Box 4240, D–40853 Ratingen.
Doka, "Doka Climbing Systems", 9 pages, undated.
"Flying High", Concrete Engineering International, Nov./Dec. 1999, 3 pages.
"Self–Climber", Patent Construction Systems, 11 pages, undated.
PERI ACS, "ACS Automatic Climbing System", catalog, pp. 569–570, undated.

* cited by examiner

*Primary Examiner*—Jong-Suk (James) Lee
(74) *Attorney, Agent, or Firm*—Kent A. Herink; Daniel A. Rosenberg; Davis Law Firm

(57) ABSTRACT

A self-climbing concrete wall form hoist for forming a concrete wall section atop a previously formed wall section has a wall mounting releasably secured to the previously formed wall section, a moveable vertical mast, a channel in the wall mounting which guideably receives the moveable mast, a platform alternatively supported on the mast and on the wall mounting, upper and lower dog latch assemblies mounted on the platform and pivotable between a platform raising position when the mast is supported on the wall mounting and a mast raising position when the platform is supported on the wall mounting, and an extensible and retractable linear actuator interconnecting the upper and lower dog latch assemblies for raising the platform relative to the mast when the dog latch assemblies are in the platform raising position and for raising the mast relative to the platform when the dog latch assemblies are in the mast raising position. The self-climbing concrete wall form hoist can descend a wall by effectively reversing the steps required to complete wall climbing.

7 Claims, 12 Drawing Sheets

WALL CLIMBING FORM HOIST

BACKGROUND OF THE INVENTION

1. Field of the Invention

This invention relates to hoists used in building concrete walls and in particular to a wall climbing form hoist for handling form units in the construction of concrete wall structures for multi-story buildings.

2. Background of the Prior Art

In the construction of a multi-story building, such as an office building, apartment building and the like, these buildings may have thirty or more floors. Where concrete is used in the construction of the outside or inside walls, it is necessary to provide cranes in the setting up and then stripping of the forms from a set wall panel for reuse in continuing the completion of the wall. Unless a crane is available as required in the setting up and stripping of the forms the wall not only becomes costly, but additional cost increases are incurred by lost time on other operations, that must be performed on a meshing or synchronized time schedule with the wall forming operation. It is apparent also that appreciable down time of the crane may take place, when it could be more efficiently utilized on other jobs at the building site. Where open crane time for timely handling of the form units is not available, construction usually proceeds behind schedule with resultant monetary losses. In some instances, the size of the building being constructed relative to the building site may preclude the use of a crane.

A system for constructing concrete walls about two stories high is shown in U.S. Pat. No. 2,516,318; and for multi-story buildings, in U.S. Pat. Nos. 4,043,087; and 2,118,374. Self-lifting form systems now in use are generally cumbersome and, although inconvenient to manipulate during both a wall climbing operation and a form handling operation, have been found to be generally satisfactory. U.S. Pat. No. 3,628,223 discloses a climbing form hoist that includes a telescopic mast comprised of a pair of vertical lower mast sections for telescopically receiving associated upper mast sections which are extended and retracted by a common reversible electric motor. The upper mast sections carry an outer form unit. With the mast retracted and attached at its lower end to a completed lower wall section, the inner and outer form units are braced or tied together in any well-known manner after which a new lift or wall section is poured. When the new pour has set, the outer form unit, after being stripped from the wall structure, is elevated by the extension of the upper mast sections to a new pour position wherein its lower end is attachable to the previously poured wall section. The lower mast sections are then released from the wall, the upper mast section is retracted and the lower mast section again connected to the wall. The inner form unit is then repositioned for another lift to be poured.

U.S. Pat. No. 4,290,576 discloses a climbing scaffolding which utilizes a guiding rail only as a vertical guide, but not to support the load resulting from the weight of the scaffolding in the vertical direction. The '576 patent requires its operators to manually fix the scaffolding in its lifted position by inserting pins into cutouts or by placing wedges underneath to support the load. U.S. Pat. No. 5,000,287 discloses a displaceable platform which is movable sectionwise on a wall, comprising support shoes, carrying rails, and a bracketing arrangement to support the platform. The thrust of the '287 patent is the correction of non-uniform upward travel of its displacement elements through very small advancements on a toothed displacement rack and a common drive and controller apparatus that prohibits further upward displacement until all linear drives have completed the preceding working step or one of the proceeding working steps. While the ratcheting mechanism of the '287 patent's tooth displacement rack may provide for fewer incidents of jamming, therefore minimizing related down time due to mechanical failures, the construct of the present invention is designed such that the platform will move in a substantially level manner without the need to correct the movement along one rail while fixing the position of the platform along another rail.

U.S. Pat. No. 5,630,482 discloses a self-climbing device which utilizes two types of scaffolding shoes: one for guiding and one for guiding and exhibiting attachment devices; two types climbing heads: a lower head with a pivotable member supported by a sidewall enclosure, and an upper head with a pivotable member supported by two additional housing walls provided between the outer housing walls of the sidewall enclosure; and two types of protuberances extending from a guide rail which provide, in a plurality of steps, a locking and loosening means by which a platform may be lifted or lowered along the length of a mounting rail. The present invention alleviates much of the complexity of the '482 patent by providing a simplified means for alternately supporting the wall climbing form hoist and moving the mounting rail or mast by utilizing one type of mounting support and a simplified mounting rail or mast.

SUMMARY OF THE INVENTION the wall climbing form hoist of the present invention provides for an appreciable reduction both in the amount of labor and crane time required in the construction of multi-story outside or inside concrete walls (for example interior core shafts like stairwells and elevator shafts). The hoist is efficient in operation to handle both the inside and the outside form units for the pouring and setting of successive lifts or horizontal wall sections and is readily adapted for handling form gangs. The hoist is hydraulically operated and remotely controlled and includes a platform or scaffold upon which workmen can be safely carried. A base or supporting frame carries the platform and the outer form unit. A pair of masts are releasably secured to a lower section of the poured concrete wall and movably carried on the base frame for relative up and down movement by a hydraulic cylinder and a pair of ratcheting dog latch assemblies, a movement much like that undertaken in the operation of a common car jack, where a human arm provides a force like that of a hydraulic cylinder on a ratcheting means which displaces a vehicle while preventing the reversal of such a displacement.

With the first two stories of the concrete wall structure previously constructed in any suitable manner, two pair of mounting supports are secured to the poured wall sections and the hoist is lifted in position by a crane or suitable alternative means to provide for the securement of the masts to the wall and the setting of the outer form unit and an inner form unit for a new pour. When the new pour has set, the support frame is supported on the upper mounting supports and the hydraulic cylinder and latch dog assemblies are used to move the masts upwardly a story height. The support frame is moved upwardly relative to the masts to locate the form unit in a next pour position wherein the lower end thereof is attached to a base sill secured to the set pour. A new pour is then made and the cycle of operations repeated until a desired height of the wall structure is attained. A further advantage of the invention is its ability to overcome uneven sections of poured wall through the utilization of shims mountable when necessary between the wall and the wall mounting assemblies. In an embodiment of the invention, linear activators are positioned such that the base frame and.masts are manipulated to lower the climbing form hoist a distance equal to the length of its ascent path, or a portion thereof. In another embodiment of the invention a crane is utilized to lower the climbing form hoist to the ground.

DETAILED DESCRIPTION OF THE DRAWING

Figure 1:
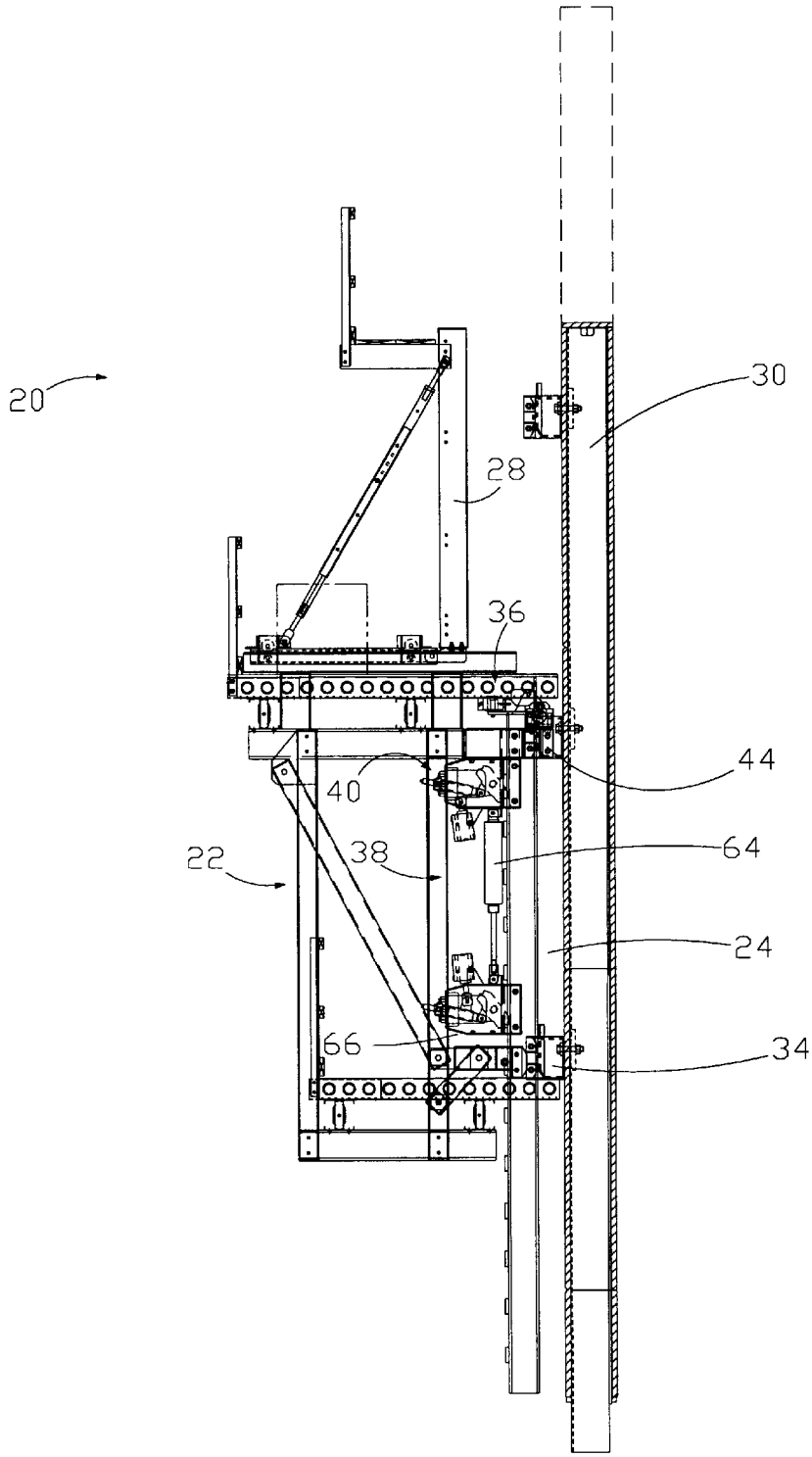
FIG. 1 is a side elevational view of the wall climbing form hoist of the present invention shown attached to a concrete wall that is being formed by the wall climbing form hoist.

Referring to FIG. 1 of the drawings, the wall climbing form hoist of this invention, indicated generally at 20, is illustrated as including a platform or support frame 22 which is supported for vertical movement on a pair of masts 24 and 26 which are of an I-shape in transverse cross section. The support frame 22 adjustably carries a vertical form panel 28 for sliding movement toward and away from an outer surface of a concrete wall 30 being constructed.

Figure 2:
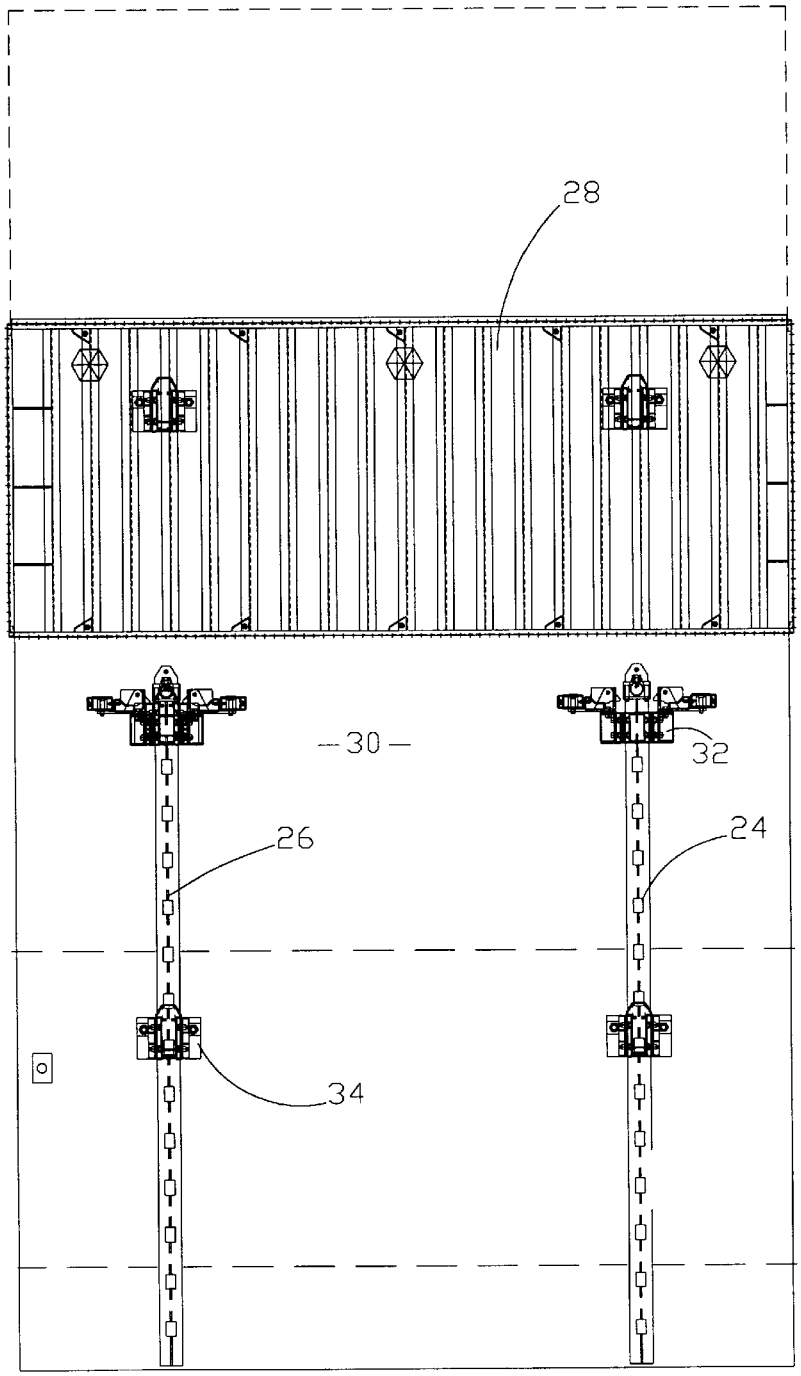
FIG. 2 is a front view of the wall climbing form hoist with parts of the associated scaffolding removed for clarity.

As best illustrated in FIG. 2, a rear flange of each of the masts 24 and 26 are guideably received inside a pair of wall mounting bases, upper wall mounting base 32 and lower wall mounting base 34. The wall mounting bases 32 and 34 are releasably secured to the concrete wall 30, typically by bolts (not shown) which are received in throughbores formed in the wall 30.

The support frame 22 includes an upper deck assembly 36 and a lower frame assembly 38 which depends therefrom. The lower form assembly 38 consists of sufficient horizontal, vertical, and diagonal frame members to complete a generally box shaped lower frame assembly 38. A pair of upper dog latch assemblies 40 and 42 are received in a pair of platform mounting assemblies 44 and 46 which in turn are secured to the upper deck assembly 36 on the right and left sides thereof, respectively. As will be described in more detail below, the dog latch assemblies are operated to alternatively engage in release from the mast to assist in the self-climbing action of the wall form hoist 20.

The platform mounting assemblies 44 and 46 are slideably received about the forward flange of the corresponding one of the masts 24 and 26, in the same manner as the wall mounting bases 32 and 34 slideably receive the rear flange of the masts 24, 26. The platform mounting assemblies 44 and 46 (FIG. 4) assist in maintaining the relative alignment of the wall climbing form hoist 20 as it climbs the concrete wall 30 and also, as will be described in more detail below, support the weight of the wall form hoist 20 while the masts are being moved.

Figure 7:
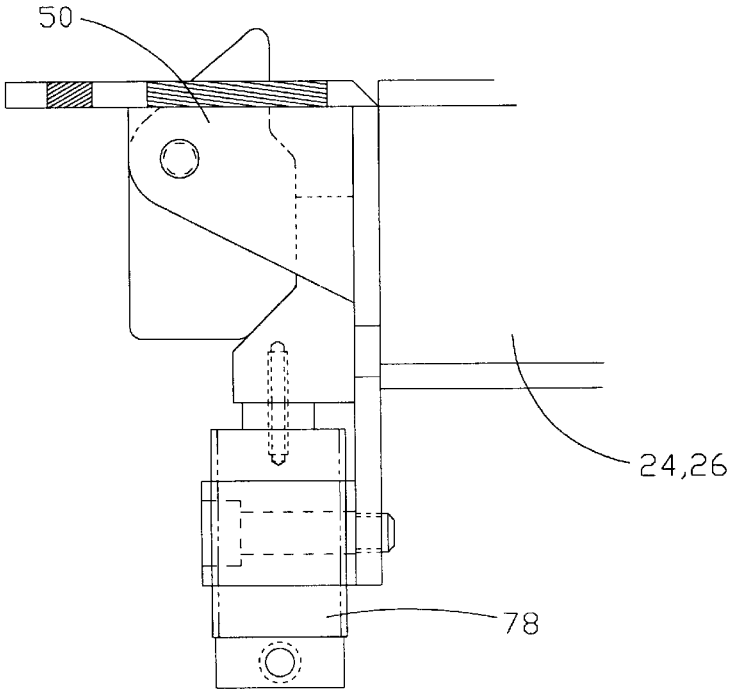
FIG. 7 is an enlarged detail view of the upper end of the mast assembly of FIG. 6*b*.

As recited above, the masts 24 and 26 are slideably received inside the wall supports 32 and 34. Because the masts 24 and 26 freely slide within the channels of the wall supports 32 and 34, they must be supported to maintain their adjusted positions. One means of support is a pivotable finger 50 (see FIGS. 6 and 7) mounted at the top of the masts 24 and 26. As the masts 24 and 26 are moved upwardly, the finger 50 will come into contact with the wall supports 32 and 34. The shape of the fingers 50 will cause it to pivot out of the way to allow the upper end portion of the masts 24, 26 to pass above the wall support 32, 34. Thereafter, if the masts 24, 26 are released, the finger 50 will engage the upper edge of the wall support 32, 34 and prevent the mast from dropping further.

Figure 5A:
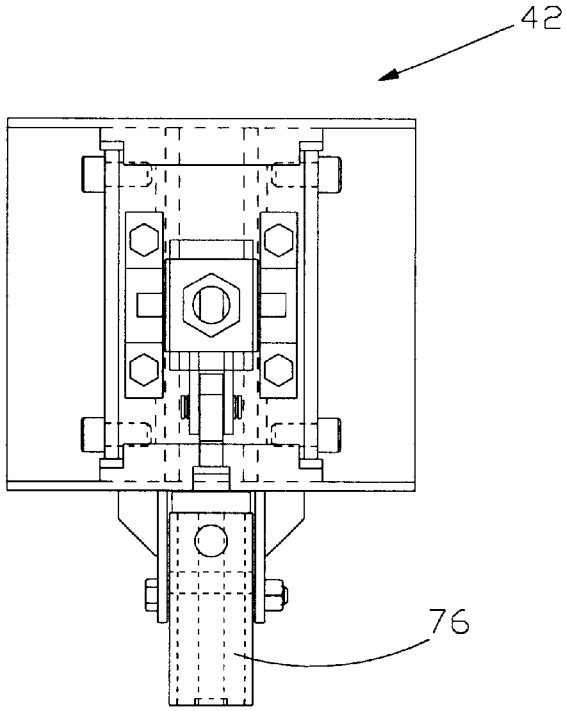
FIGS. 5*a*–5*c* are a front view, top view, and side view, respectively, of dog latch assembly.
Figure 5B:
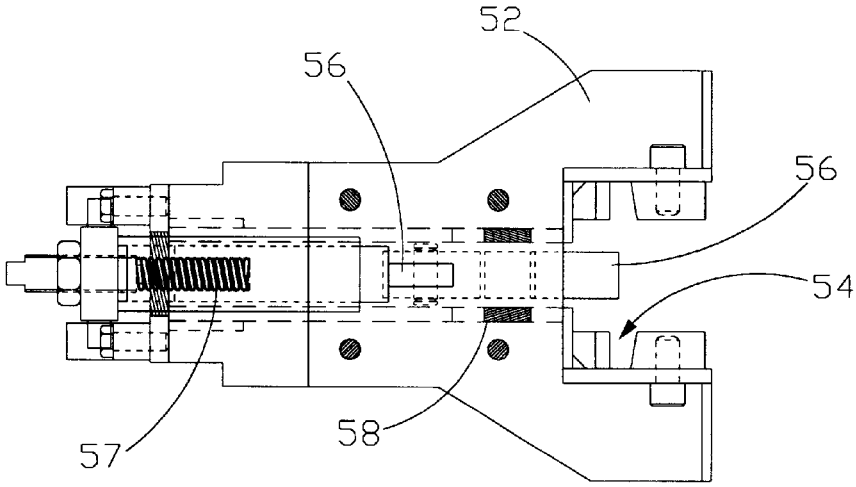
Figure 5C:
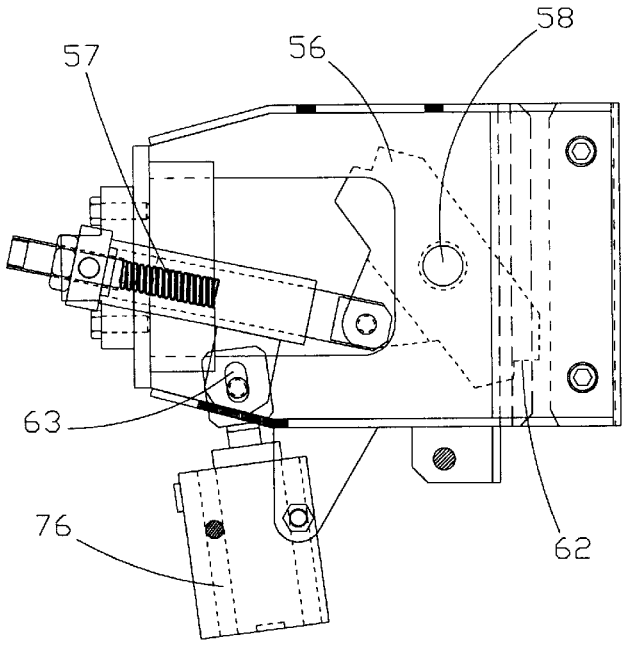
Figure 8:
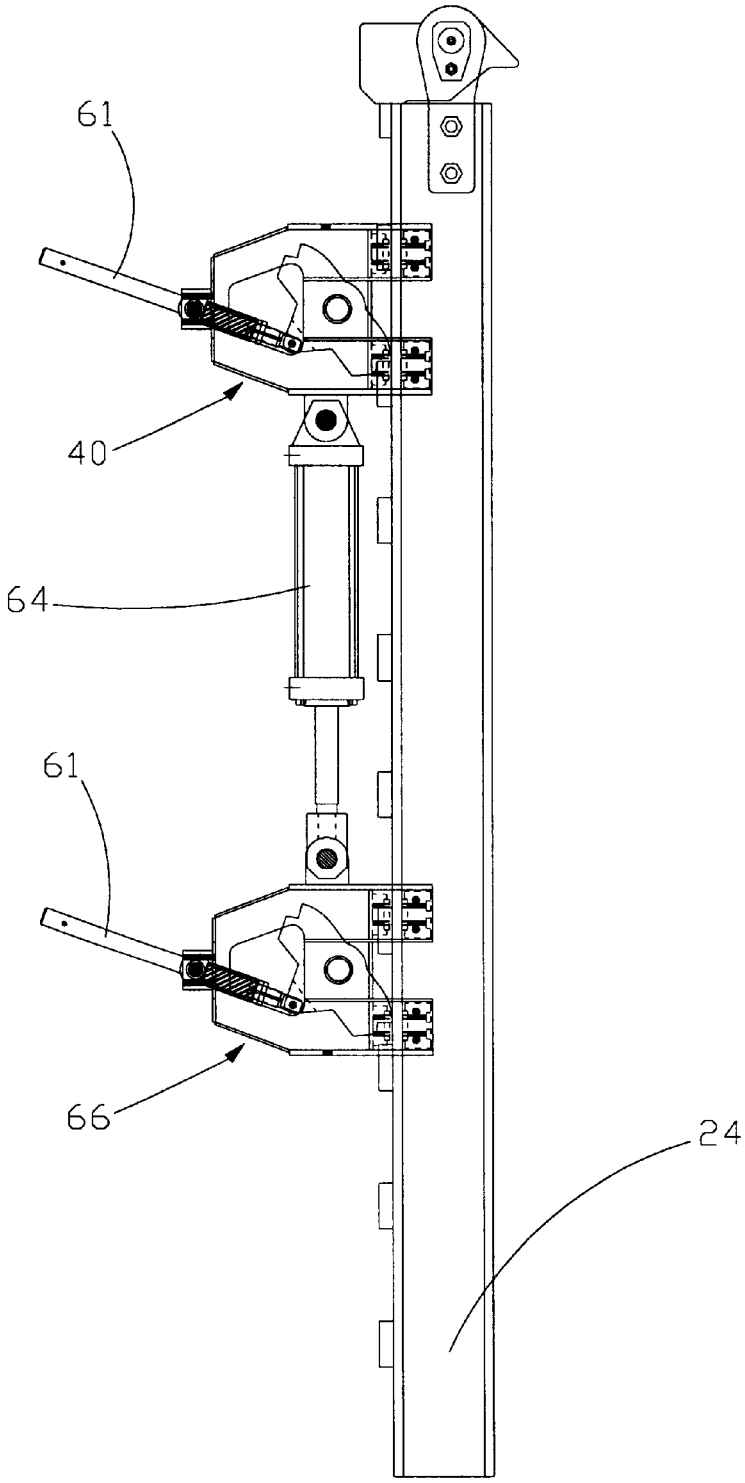
FIG. 8 is an enlarged detail view of a hydraulic cylinder extending between upper and lower dog latch assembliew of the present invention.

The dog latch assemblies 40 and 42 are illustrated in detail in FIGS. 5*a*–5*c*. Each dog latch assembly 40, 42 includes a mounting collar 52 that includes a channel 54 which accommodates the foward flange of the masts 24, 26. A dog 56 is mounted for pivotable movement about a horizontal axis located centrally of the dog 56 and defined by a horizontal mounting pin 58. The dog is pivotable between a first position in which a lower end portion of the dog 56 is extended by spring 57 into the area between the channels 54 and a second position in which an upper end portion of the dog 56 is extended by spring 57 between the channels 54. The first position is illustrated in FIG. 5*c*. The pivot of the dog 56 between the first and second positions can be accomplished manually by repositioning handle 61 (FIG. 8), or through the action of a hydraulic cylinder 76 (as shown in FIGS. 1 and 5). Elongated hole 63 allows sufficient mobility during dog pivoting operations between the first and second positions.

Figure 6A:
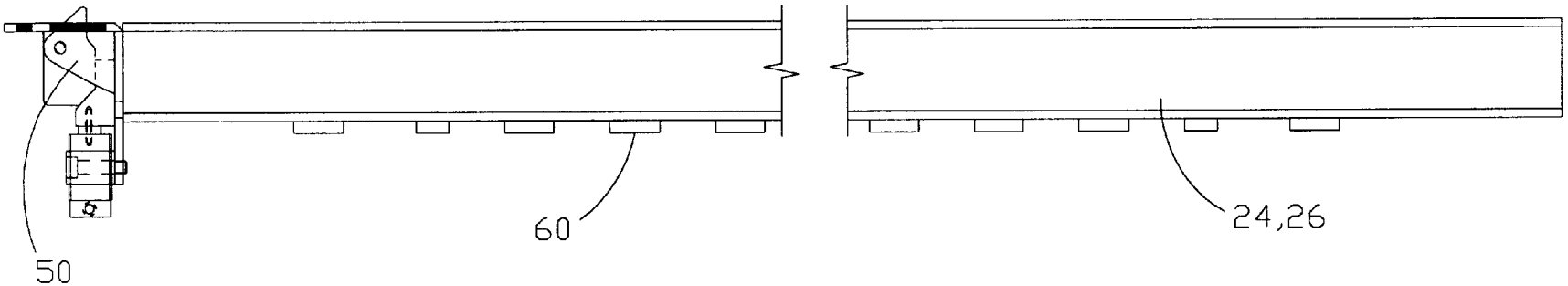
FIGS. 6*a* and 6*b* are front and side views, respectively, of a mast assembly of the present invention.
Figure 6B:
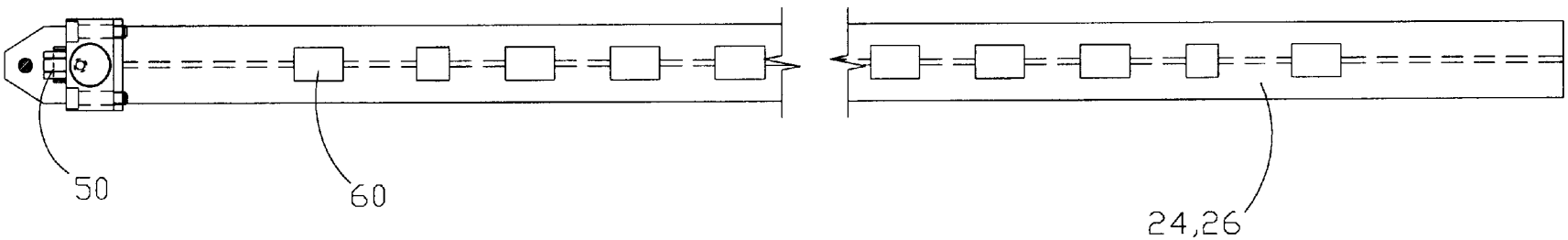

As illustrated in FIG. 6, the outwardly facing face of forward flange of the masts 24, 26, include a plurality of regularly spaced cleats 60. The upper and lower end portions of the dog 56 are shaped with a notch 62 which are adapted to engage the cleats 60 as will be described in more detail.

Below each of the upper dog latch assemblies 42 on either side of the form hoist 20 is located a lower dog latch assembly 66. Similar to the upper dog latch assemblies 42, the lower dog latch assemblies 66 are received about a corresponding one of the masts 24, 26 for sliding movement vertically relatively thereto. In contrast, however, to the upper dog latch assemblies 42, the lower dog latch assemblies 66 are only connected to the support frame 22 by a corresponding one of a pair of hydraulic cylinders 64 (see FIG. 1). The lower dog latch assemblies 66 are constructed nearly identically to the upper dog latch, assemblies 42 in that they also include a pivotable dog that can move into and out of supporting contact engagement with the cleats 60 of either of the masts 24, 26.

The construction of the dog latch assemblies 42 and 66 act to support the weight of the wall climbing form hoist 20 by contact engagement of the notches 62 with the upper portion of a corresponding one of the cleats 60 so that once the dog latch assembly 42, 66 is raised to a position such that the lower proximate end portion of the dog 56 just clears the upper surface of a corresponding one of the cleats 60, the dog latch assembly 42, 66 can be loaded and it will latch into place supporting the full weight of the wall climbing form hoist 20 on the masts 24 and 26. Accordingly, by alternately supporting the wall climbing form hoist 20 on the upper dog latch assembly 42 and then the lower dog latch assembly 66, the hydraulic cylinder 64 can be used to raise the wall climbing form hoist in a ratchet fashion.

Figure 3A:
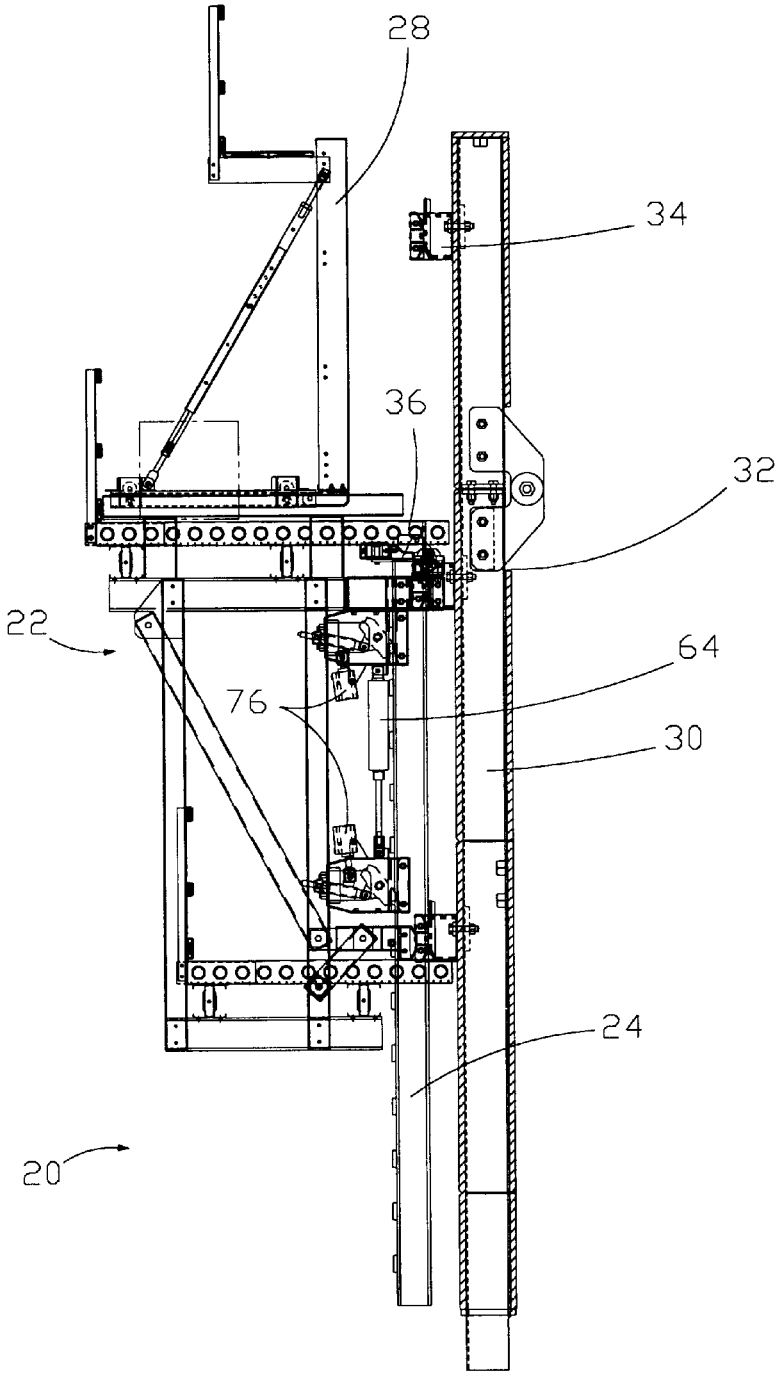
FIGS. 3*a*–3*d* are side elevational views showing the climbing action of the wall climbing form hoist of FIG. 1.
Figure 3B:
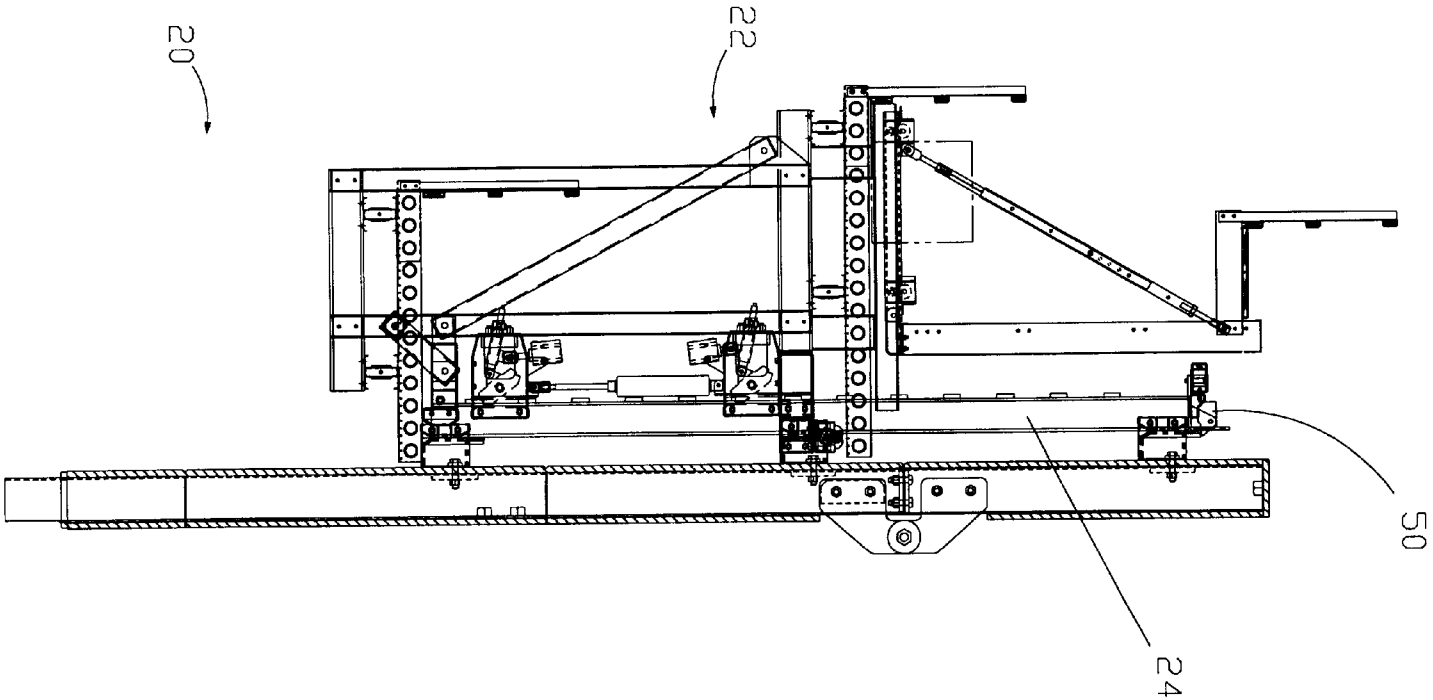
Figure 4A:
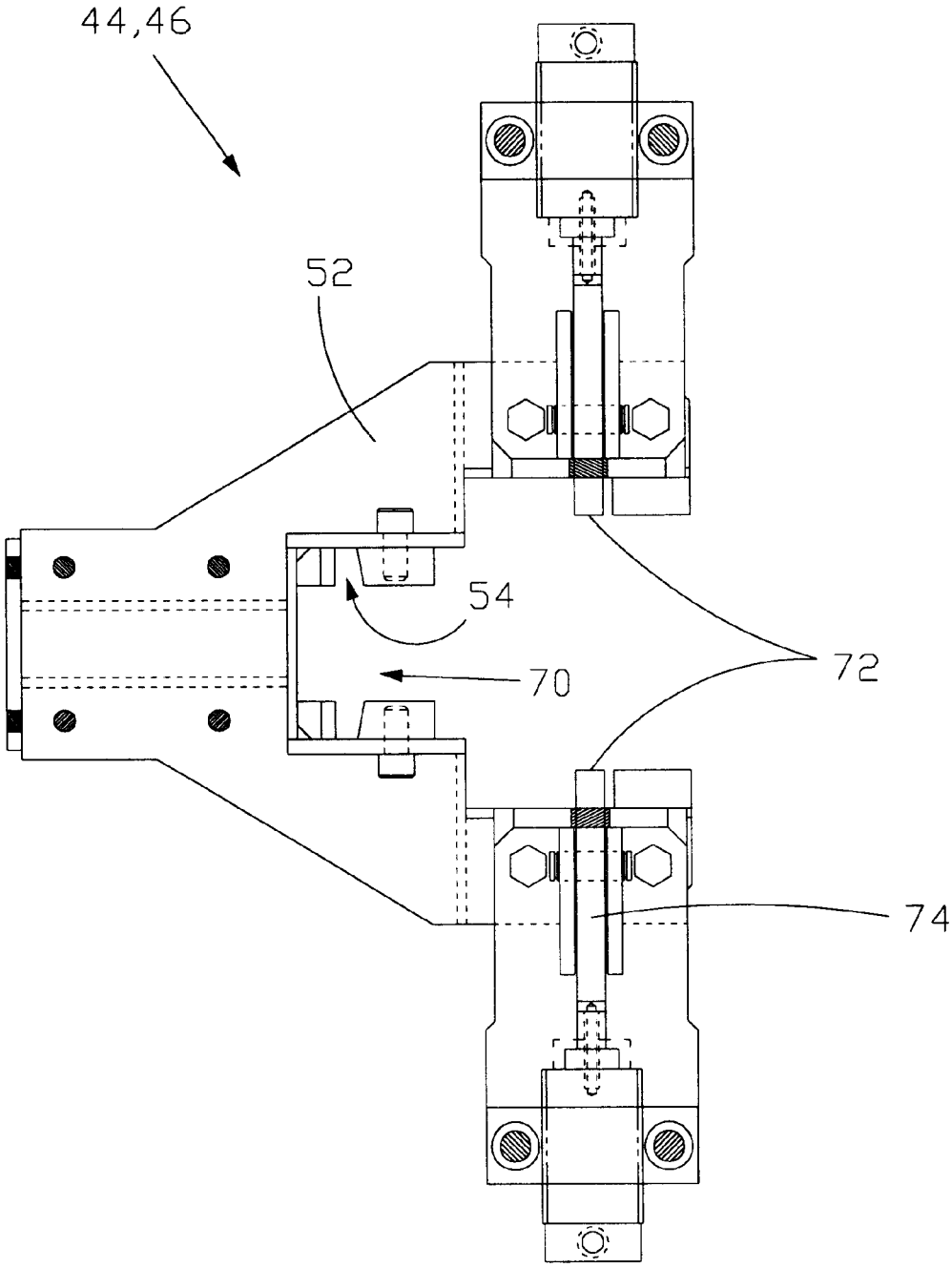
FIGS. 4*a*–4*b* are enlarged detail views of a mount base assembly that is used for supporting portions of the wall climbing form hoist on a moveable mast.
Figure 4B:
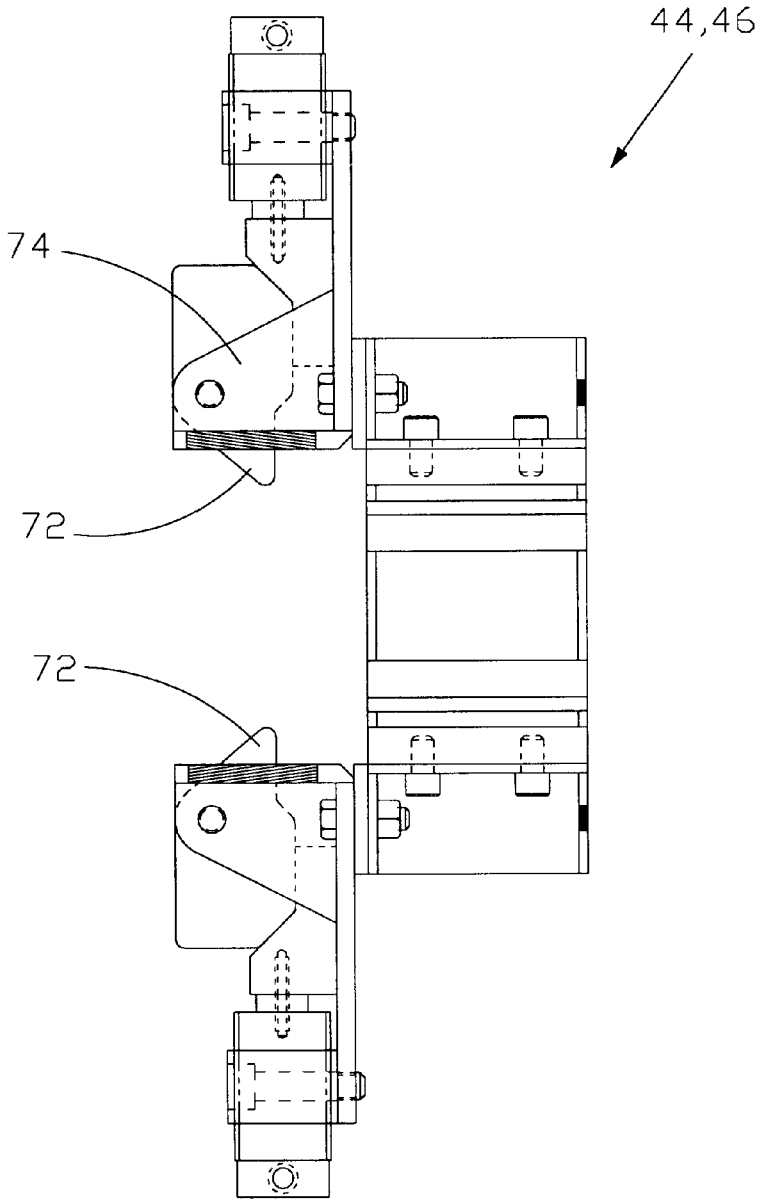

The action of the wall climbing form hoist 20 will be more fully understood by reference to a description of a cycle of the wall climbing form hoist 20 in pouring a story of a concrete wall for a structure. Initially, two stories of a concrete wall 30 are poured in a conventional fashion. Once the concrete has set, a crane or other independent hoist means is used to lift the wall climbing form hoist 20 into position adjacent the concrete wall 30. The two pairs of upper mounting supports 32 and 34 are releasably secured to the concrete wall 30 by any suitable means. In this position, as illustrated in FIG. 3*a*, the wall climbing form hoist 20 is supported on the upper pair of mounting supports 32 by a pair of mount base assemblies 44, 46 (FIG. 4). The mount base assemblies 44, 46 are secured to the upper deck assembly 36 and extend toward the concrete wall 30. The mount base assemblies 44, 46 include a channel 70 that is of a size and shape to be received about a corresponding one of the masts 24, 26. On either side of channel 70 is located a pivotable finger 74 that is pivotable between a engaging position wherein the projecting portion 72 of the finger 74 extends into the channel 70. The fingers 72 are positioned so that the projecting portion 74 will engage the top of the upper mounting supports 32 when in the appropriate position and, accordingly, will act to support the wall climbing form hoist 20. The vertical form panel 28 is advanced towards the wall 30 until it is in position to form the adjacent surface of the next story. A corresponding form panel is positioned on the opposite side of the concrete wall 30 by conventional forming methods or, alternatively, by another wall climbing form hoist. Concrete can then be poured between the opposing forms which are left in place until the concrete cures.

Once the concrete cures, the vertical form panel 28 is retracted away from the newly formed face of the concrete wall 30. Another pair of upper mounting supports 34' are releasably attached in the new concrete wall section positioned vertically above the other mounting supports on the lower sections.

At this time, the hydraulic cylinders 64 are extended, resulting in movement of the lower dog latch assembly 66 downwardly. Once the upper end portion of the dogs 56 clears the lower end portion of a corresponding one of the cleats 60 of the masts 24, 26, the hydraulic cylinder 64 is stopped and reversed. Upon reversal, the notch 62 in the upper end portion of the dogs 56 will engage the lower end portion of the corresponding cleat 60. Further retraction of the hydraulic cylinder 64 will raise the masts 24, 26. As the masts 60 move past the dog 56 in the upper latch assembly 42, the dog 56 will allow the cleats 60 and the masts 24, 26 to pass. After the hydraulic cylinder 64 has been fully retracted, it is again extended. As it begins its extension, the cleat 60 next above the dog 56 of the upper latch assembly 42 will engage with the upper end portion of the notch 62 in the dog 56, thus preventing the masts 24, 26 from falling. This cycle is repeated until the masts 24, 26 have been raised a full story wherein the upper end portion of the masts 24, 26 has passed through the newly mounted upper mounting supports. The hydraulic cylinders 64 are then extended until the fingers 50 on the upper end portion of the masts 24, 26 engage the newly mounted upper mounting supports and thereby support the masts 24, 26.

Figure 3C:
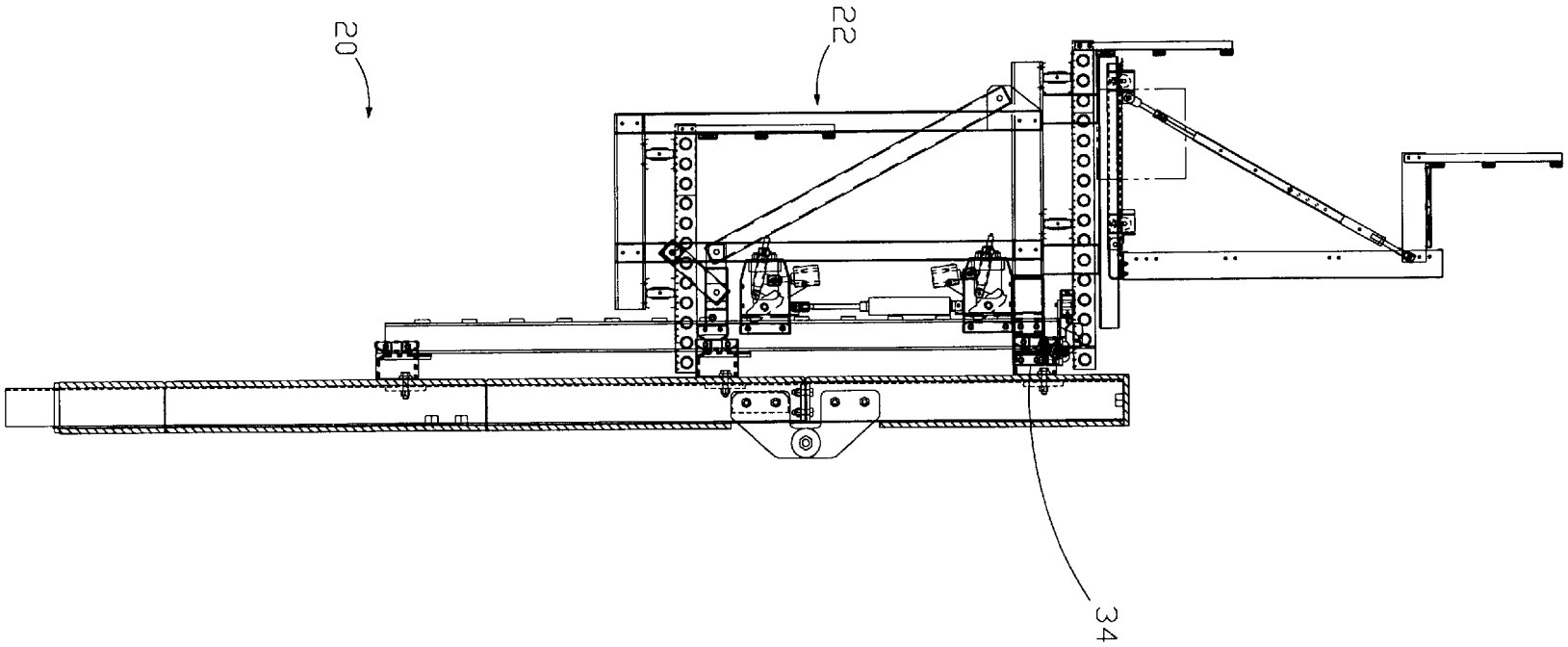
Figure 3D:
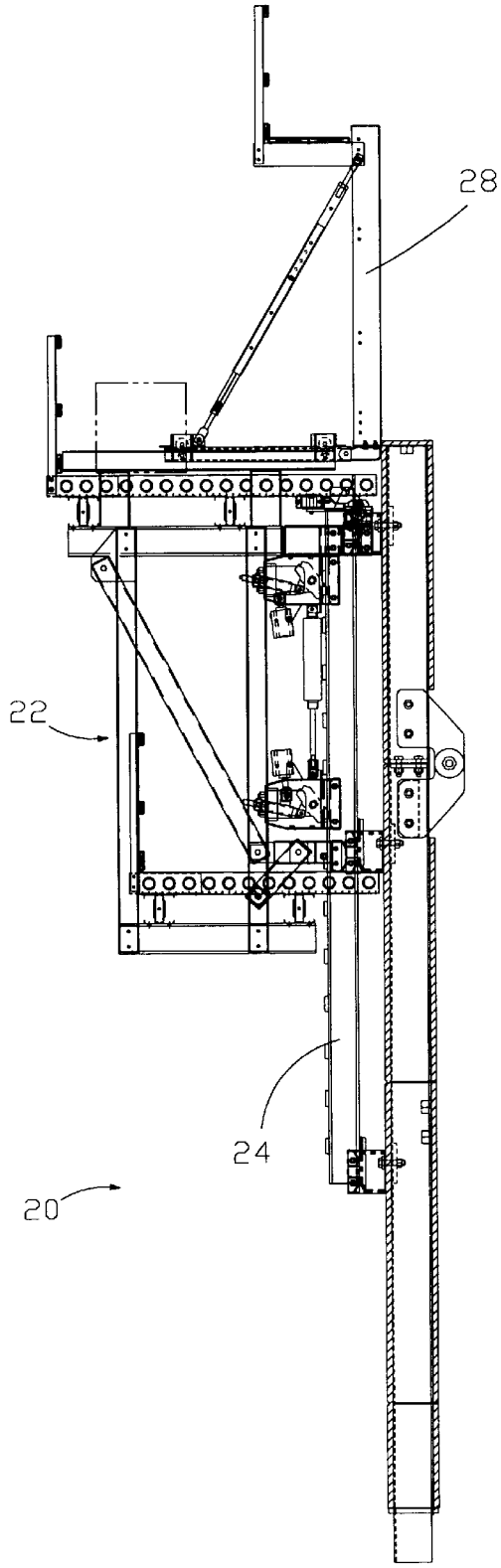

The hydraulic cylinders 64 are again extended and retracted. This time, however, since the masts 24, 26 are supported on the upper mounting supports, the lower end portions of the dogs will alternatively engage successive cleats on the masts. Accordingly, the upper dog latch assemblies 42 and the lower dog latch assemblies 66 will alternatively be engaged and supported on the masts 24, 26. In this way, the wall climbing form hoist 20 is ratcheted upwardly relative to the masts 24, 26 (FIG. 3*c*). The entire cycle can then be repeated until the full height of the concrete wall 30 has been poured.

Once the full height of the wall is poured, the wall climbing form hoist 20 is normally picked off of the building by a crane. Alternatively, The form hoist 20 can be adapted for lowering itself down the formed wall. In this procedure, the masts 24, 26 and support frame 22 are alternatively and sequentially lowered using the hydraulic cylinders 64 as above, except that the dog latches are manually operated, such as by handle 61, or a hydraulic cylinder 76, to allow the latches to clear the adjacent cleat and permit lowering of the platform 22 and masts 24, 26, similar in the way in which an automobile jack is operated to lower the automobile. Additionally, a plurality of hydraulic cylinders 78 (FIGS. 4 and 7) are shown for moving of the fingers 50 and 72 to allow the masts 24, 26 and platform 22, respectively, to move past the mounting assemblies or bases 32 and 34. Accordingly, in an embodiment of the climbing form hoist, the movement of the form hoist to a downward position may be effectuated under its own power rather than being picked off by a crane.

The foregoing description and drawings comprise illustrative embodiments of the present inventions. The foregoing embodiments described herein may vary based on the ability, experience, and preference of those skilled in the art. The foregoing description and drawings merely explain and illustrate the invention, and the invention is not limited thereto, except insofar as the claims are so limited. Those skilled in the art who have the disclosure before them will be able to make modifications and variations therein without departing from the scope of the invention.

We claim:

1. A self-climbing and self-lowering concrete wall form hoist for forming a concrete wall section atop a previously formed wall section, comprising:

a) a wall mounting releasably secured to a previously formed wall section;

b) a moveable vertical mast comprised of an engagement surface;

c) a channel in the wall mounting which guideably receives the moveable mast;

d) a means for releasably supporting the mast or platform on the wall mounting;

e) a platform alternatively supported on the mast or on the wall mounting;

f) upper and lower dog latch assemblies mounted on the platform, each of the dog latch assemblies further comprising;

g) a dog comprising of an upper end portion including an engagement device and a lower end portion including an engagement device, the dog being pivotable about a central axis to be engaged to the mast with one of the upper and lower end portions between a platform-raising-position when the mast is supported on the wall mounting, and a mast-raising-position when the platform is supported on the wall mounting h) the upper and lower dog latch assemblies being further pivotable between a platform-lowering-position when the mast is supported on the wall mounting and a mast-lowering-position when the platform is secured to the wall mounting, i) an extensible and retractable linear actuator interconnecting the upper and lower dog latch assemblies for raising the platform relative to the mast when the dog latch assemblies are in the platform-raising-position and for raising the mast relative to the platform when the dog latch assemblies are in the mast-raising-position; and, j) the extensible and retractable linear actuator further interconnecting the upper and lower dog latch assemblies for lowering the platform relative to the mast when the mast is supported on the mounting assembly and when the dog latch assemblies are in the platform-lowering-position, and for lowering the mast relative to the platform when the platform is supported on the mounting assembly and when the dog latch assemblies are in the mast-lowering-position.

2. The self-climbing and self-lowering concrete wall form hoist of claim 1, wherein said vertical mast comprises a plurality of regular spaced cleats.

3. The self-climbing and self-lowering concrete wall form hoist of claim 2, wherein the dog is pivotable between the platform-raising-position and the platform-lowering-position by manually repositioning a handle.

4. The self-climbing and self-lowering concrete wall form hoist of claim 2, wherein the regular spaced cleats are further defined as having engagement surfaces comprised of corners, or right angles.

5. The self-climbing and self-lowering concrete wall form hoist of claim 2, wherein the lower end portion of the dog is brought into contact engagement with one of the regularly spaced cleats of the mast when the dog is pivoted to the platform-raising-position, and wherein the upper end portion of the dog is brought into contact engagement with the regularly spaced cleats of the mast when the dog is pivoted to the, mast-raising-position.

6. The self-climbing and self-lowering concrete wall form hoist of claim 1, wherein the means for releaseably securing the mast or platform to the wall mounting comprises at least one pivotable support finger which releasably engages the wall mounting.

7. The self-climbing and self-lowering concrete wall form hoist of claim 1, wherein the engagement device comprising a notch.

* * * * *